US005577305A

United States Patent [19]

Johnson

[11] Patent Number: 5,577,305

[45] Date of Patent: Nov. 26, 1996

[54] FASTENER ASSEMBLY

[76] Inventor: James R. Johnson, 3819 Greenhill Dr., Chamblee, Ga. 30341

[21] Appl. No.: 436,573

[22] Filed: May 8, 1995

[51] Int. Cl.[6] ..... A44B 19/00; B65D 33/00

[52] U.S. Cl. ..... 24/587; 24/400; 24/576; 383/63

[58] Field of Search ..... 24/587, 576, 399, 24/400; 383/5, 63, 65

[56] References Cited

U.S. PATENT DOCUMENTS

| | | | |
|---|---|---|---|
| Re. 28,969 | 9/1976 | Naito | 150/3 |
| 3,202,559 | 8/1965 | Laguerre | 156/66 |
| 3,323,707 | 6/1967 | King | 229/66 |
| 3,416,199 | 6/1965 | Imamura | 150/3 |
| 3,425,469 | 2/1969 | Ausnit | 24/587 |
| 3,459,870 | 8/1969 | Plummer | 383/63 |
| 3,554,822 | 1/1971 | Schwarnhopf et al. | 196/66 |
| 3,565,147 | 2/1971 | Ausnit | 150/3 |
| 3,806,998 | 4/1974 | Laguerre | 24/400 |
| 4,212,337 | 7/1980 | Kamp | 150/3 |
| 4,337,889 | 7/1982 | Moertel | 229/62 |
| 4,363,345 | 12/1982 | Scheibner | 150/3 |
| 4,498,939 | 2/1985 | Johnson | 156/66 |
| 4,561,108 | 12/1985 | Kamp | 383/63 |
| 4,617,683 | 10/1986 | Christoff | 383/63 |
| 4,655,862 | 4/1987 | Christoff et al. | 156/66 |
| 4,673,383 | 6/1987 | Bentsen | 493/381 |
| 4,709,399 | 11/1987 | Sanders | 383/66 |
| 4,736,496 | 4/1988 | Fisher et al. | 24/587 |
| 4,812,056 | 3/1989 | Zieke | 383/65 |
| 4,829,641 | 5/1989 | Williams | 24/587 |
| 4,964,739 | 10/1990 | Branson et al. | 383/5 |
| 5,012,561 | 5/1991 | Porchia et al. | 24/576 |
| 5,157,811 | 10/1992 | Bodolay | 24/30.5 |
| 5,192,135 | 3/1993 | Woods et al. | 24/587 |
| 5,209,574 | 5/1993 | Tilman | 383/63 |
| 5,211,481 | 5/1993 | Tilman | 383/63 |
| 5,368,394 | 11/1994 | Scott et al. | 383/63 |

FOREIGN PATENT DOCUMENTS

| | | | |
|---|---|---|---|
| 2260972 | 9/1975 | France | 24/587 |
| 4294747 | 10/1992 | Japan | 383/63 |

*Primary Examiner*—Victor N. Sakran
*Attorney, Agent, or Firm*—Michael, Best & Friedrich

[57] ABSTRACT

An improved fastener assembly for reclosable plastic containers is provided. The assembly includes a male closure element having a male base member which is elastically deformable and resilient and a barb element extending substantially perpendicularly therefrom. A female closure element has a base with a substantially C-shaped track disposed thereon. The C-shaped track is constructed and arranged for selective engagement with the male closure element. The female base member is also elastically deformable and resilient. At least one of the base members has a curved exterior surface which deforms when sealing pressure is applied, thereby facilitating sealing of the fastener assembly to reclosable plastic bags by correcting for variations in pressure, temperature, and angle of the sealing bars.

24 Claims, 3 Drawing Sheets

FASTENER ASSEMBLY

The present invention relates generally to reclosable plastic bags having fastener assemblies sealed thereon and more particularly to elastically deformable and resilient fastener assemblies with improved sealing capabilities to reclosable plastic bags.

Reclosable bags typically are constructed of polyethylene. As shown in U.S. Pat. No. 3,202,559, Laguerre, a method of forming plastic bags with slide fastener tape assemblies welded thereto, is known. It is commonly known in the art to manufacture reclosable plastic bags having fastener assemblies sealed to opposing walls. U.S. Pat. No. 3,416,199 shows yet another example of reclosable bags formed of two opposed walls equipped at their mouth with fastener profiles. These profiles include a male profile attached to one wall and a female profile attached to the other wall. The profiles are shaped so that, when they are aligned and pressed together into an engaging relationship, they form a continuous closure for the bag. The bag may be opened by pulling the walls apart, thereby separating the profiles. A variety of profiles are shown in U.S. Pat. Nos. 28,969; 3,323,707; 4,212,337; 4,363,345; 4,561,108; and 4,812,056. In addition, U.S. Pat. Nos. 4,736,496 and 5,012,561 disclose reclosable bags with profiles with profiles and internal ribs adjacent to the profiles. U.S. Pat. No. 3,565,147 discloses a rib and bar arrangement for fastener profiles. U.S. Pat. No. 5,368,394 discloses a fastener profile assembly having stabilizer wedges on the lateral flanges of both the male and female fasteners. The stabilizer wedges on the male assembly are sized and positioned to abut internally to the stabilizer wedges on the female fastener profile, but do not cushion. U.S. Pat. No. 4,964,739, Branson, discloses a tamper evident bag having a non-reusable frangible fastener profile assembly comprising two sets of lockable fastener profile elements especially constructed to manually lock together without the use of tools and which once locked cannot be forcibly pulled apart. The construction of the fastener elements also assures proper alignment of the lockable fastener profile elements across the length of the upper portion of the bag wall panels. The profile assembly includes profile guide elements located at each end of the web portion of the respective male and female profiles which project perpendicularly therefrom.

U.S. Pat. No. 4,829,641, Williams, discloses an interlocking closure device including two U-shaped closure elements with hooks on the ends of each of the U-shaped members for interlocking.

Many of the aforesaid fastener assemblies include differential opening force features; i.e., making it more difficult for the fastener assembly to be opened by product shifting against the fastener than for the user to open the assembly from outside the bag.

Although the above listed fastener profiles have achieved some degree of success, none have completely solved the problem of providing a differential opening force such that it is more difficult to open the bag from within the bag than outside, while at the same time providing a means of cushioning the fastener profiles as they are sealed, thereby providing acceptable seals within a wider range of temperature and pressure and minimizing the precision of the positioning requirements for aligning the male and female fastener profiles.

OBJECTS OF THE INVENTION

Accordingly, it is an object of the invention to provide a fastener profile assembly which cushion the fastener profiles as they are sealed, thereby providing acceptable seals within a wider range of temperature and pressure.

It is additional object of the invention to provide fastener profile assemblies which minimize the precision of the positioning requirements for aligning the male and female fastener profiles.

It is a further object of the present invention to provide fastener profiles which minimize the precision of positioning of the sealing bars relative to the fastener profiles.

It is a further object of the invention to provide fastener profile assemblies which provide an improved differential opening force for reclosable containers.

It is an additional object of the present invention to provide such fastener profiles which are low in cost, easy to manufacture, and easy for the consumer to use.

SUMMARY OF THE INVENTION

An improved fastener assembly is provided for reclosable plastic bags. The assembly includes a male closure element having a base and a stem and barb element extending substantially perpendicularly from the base. The base is elastically deformable and resilient. Similarly, a female closure element is provided having a base and a substantially C-shaped track disposed thereon. The C-shaped track has a pair of curved legs extending from the base. The C-shaped track is formed such that the male closure element and the female closure element may be selectively engaged or disengaged in an interlocking relationship. The female base member is also elastically deformable and resilient so as to make it easier to seal the fastener assemblies to the reclosable plastic bag. The elastic base of the male and female closure members allows greater compression of the closure members against the film of the plastic bag without excessive melting of the plastic. In addition, misalignment of the sealing die is corrected by the plastic nature of the base which tends to deform where pressure is applied but at the same time form a flat surface against the plastic film.

An additional feature of the invention is the use of a curved exterior surface on the elastically deformable base of either the male or female closure elements. This curved configuration is deformed when compressed by a sealing bar, thus acting as a shock absorber, and allowing a greater range of sealing pressures and temperatures used in sealing the fastener elements to a wide range of films. The base members may also include laterally arrayed flanges having ribs extending therefrom near the ends of each base. The ribs facilitate guiding and support of the fastener assembly. In a preferred embodiment, the ribs of the male closure element can be used for supporting the fastener assembly during the application process to the film with a narrowed point of contact providing reduced friction. The ribs on the female fastener assembly can be similarly constructed.

In a preferred embodiment, the barb and stem of the male fastener assembly extend perpendicularly beyond the ribs. After interlocking between the male and female closure elements, the ribs act as shock absorbers to control the degree of penetration and prevent deformation of the fastener elements. The ribs preferably have rounded tips slidably supporting the fastener assembly. Preferably, the ribs on the male closure element project angularly outward at an angle equal to or greater than 90° and the ribs on the female base member project angularly inward at an angle of less than 90° so that the impact between the two sets of ribs tends to cushion and control the amount of compression between the closure elements, thereby facilitating the sealing of the closure elements to the plastic film of the reclosable plastic container.

In a preferred embodiment, the male fastener assembly includes a channel proximate the barb, and the C-shaped track on the female element includes a flange extending from one of the legs proximate the distal end thereof. The channel is constructed, positioned, and arranged so that when the male and female closure elements are engaged in an interlocking relationship, the channel retards disengagement of the closure element on the product side of the closure element.

In a preferred embodiment, the ribs include a curved bumper element proximate thereto which is constructed and arranged for cushioned impact against the rib on the opposite closure element so as to absorb pressure applied against the closure elements during sealing.

While a preferred embodiment of the invention is disclosed, the invention is not limited thereto, except insofar as those who have the disclose before them are able to make modifications and variations therein without departing from the scope of the invention.

DETAILED DESCRIPTION OF THE PREFERRED EMBODIMENTS

Figure 1:
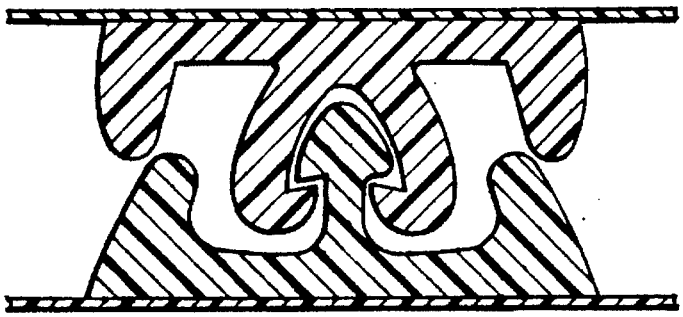
FIG. 1 (PRIOR ART)
FIG. 1 of the drawings is a vertical section of a prior art fastener construction.

As shown in FIG. 1 of the drawings, a prior art fastener assembly having a reclosable bag formed of walls defining a closure with a mouth is disclosed. The closure includes an asymmetric arrowhead male profile extending along an internal surface of one of the walls and a female profile having stubs adapted to interengage with said male profile and extending along an internal surface of the other wall. Both profiles also include stabilizer wedges on both sides thereof and parallel thereto across the width of the bag. The stabilizer wedges give the zipper formed by the male and female profiles a wide-track feel, and determine the force required to open the bag both from inside and from outside. The male and female profiles of the prior art fasteners, however, extend well beyond the ribs or wedges and therefore the wedges do not cushion the profiles during sliding.

Figure 2:
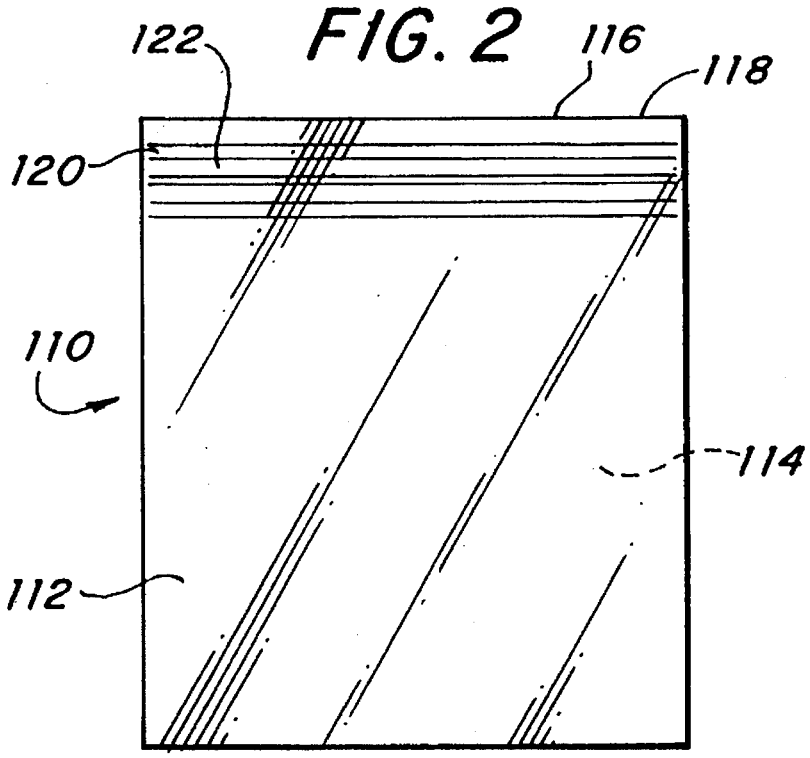
FIG. 2 of the drawings is a front view of a bag having the fastener assemblies of the present invention.

As shown in FIG. 2, a reclosable bag 110 constructed in accordance with this invention includes front and rear walls 112, 114 seamed along three edges thereby forming an enclosure with an opening or mouth 116 along the top or fourth edge 118. The bag 110 is preferably made by extrusion of a thermoplastic material such as polyethylene. Attached to the internal faces of, walls 112 and 114 are male and female profiles 112 and 120, respectively, which extend continuously from side to side of the bag. The profiles 112 and 120 serve to close the bag opening 116 when they are interlocked as shown in FIG. 2.

Figure 3:
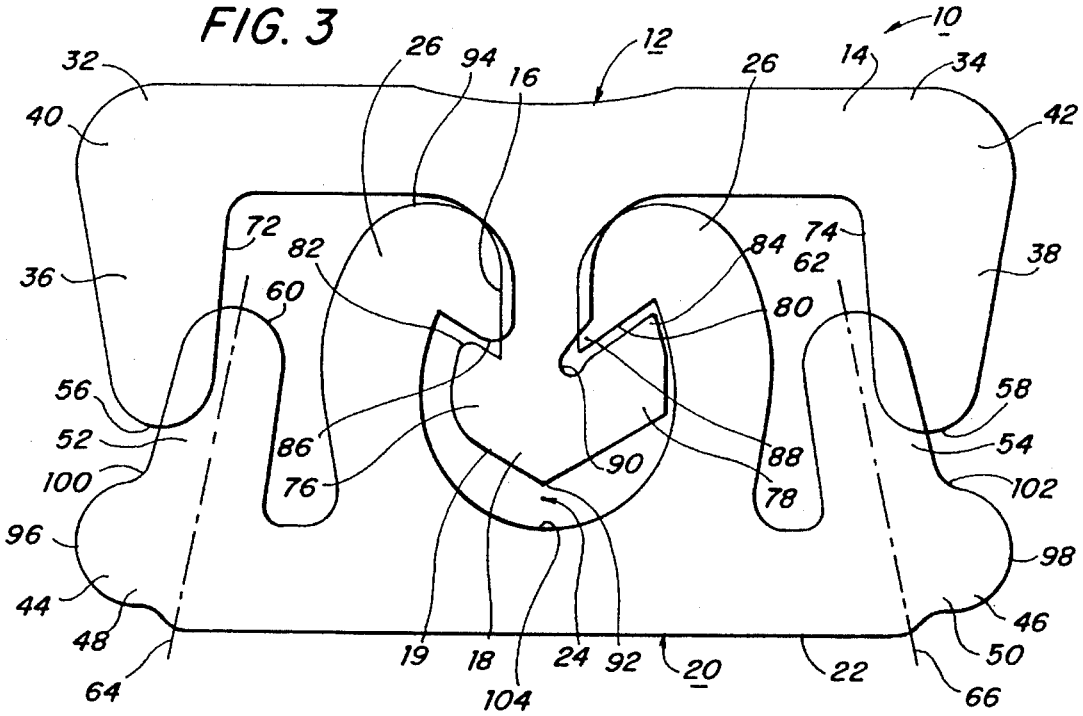
FIG. 3 of the drawings is a front view of the fastener assembly of the present invention.

As best seen in FIG. 3 of the drawings, a fastener assembly 10 is disclosed for reclosable plastic containers 110 formed of plastic film such as polyethylene. The fastener assembly 10 comprises a male closure element 12 having a base 14, a stem 16 extending substantially perpendicularly from the base, and a barb 18 affixed to the distal end 19 of the stem 16. The male base member 14 is constructed of a plastic such as polyethylene so as to be elastically deformable and resilient. In a preferred embodiment, the base member has a thickness between 0.010 and 0.020 inches, although 0.012 inches is preferred. Both the male and female closure elements in a preferred embodiment are constructed of Petrothene® brand polyethylene formulation NA 420-127 which is extruded through a screw-type extruder. Female closure element 20 includes a base 22 and a substantially C-shaped track 24 disposed on the base 22. The C-shaped track has a pair of curved legs 26 extending from the base member. The female closure element 20 is constructed so that the male closure element 12 and the female closure element 20 may be selectively engaged or disengaged in an interlocking relationship. The female base member 22 is also elastically deformable and resilient so as to facilitate the sealing of the fastener assemblies 10 to the reclosable plastic container 110.

Figure 4:
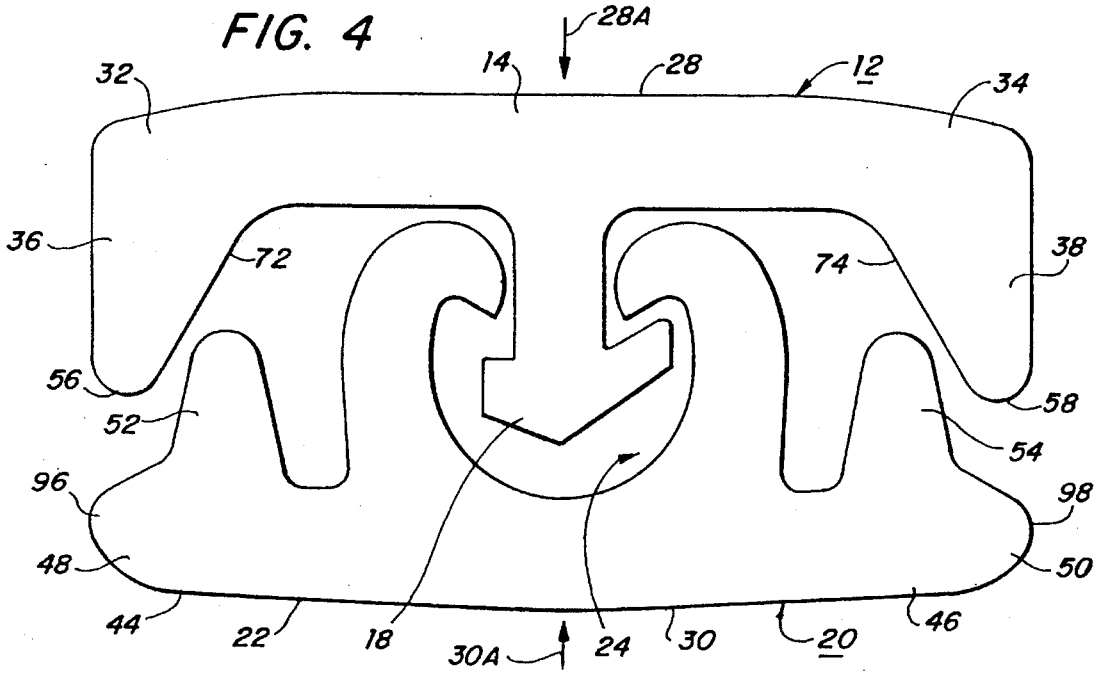
FIG. 4 of the drawings is an alternate embodiment of the fastener assembly of FIG. 3.

As seen in FIG. 4, closure elements 20 and 12 have curved exterior surfaces 28 and 30 which deform when sealing pressure is applied for sealing fastener assemblies 20 and 12 to bag 110, as shown by force lines 28A and 30A. This deflection or deformation of the base members 22 and 14 respectively causes the base members 22 and 14 to flatten when pressure is applied against them, with any gaps being filled in by the deformation of the bases 14 and 22. As a result, any misalignment of the fastener assemblies 12 and 20 is corrected. In addition, this curved and deformable construction allows additional pressure to be applied by the sealing die and/or higher temperature ranges (330° F.–380° F.) to be used, which are compensated for by the deflection of the fastener assemblies 12 and 20. The curved bases 14 and 22 act as a force cushion and a heat sink. As shown in FIG. 3, base 14 may be curved inwardly rather than outwardly, as required.

As is further seen in FIGS. 3 and 4, the male base member 14 has a pair of laterally arrayed flanges 32 and 34 having ribs 36 and 38 proximate the distal ends 40 and 42 of the base 14. The ribs 36 and 38 may be used to support the fastener assembly 10 as it runs through the sealing equipment (FIG. 5) and also may be used to guide the male closure element as it is engaged with the female closure element 20. Similarly, the female closure element 20 has flanges 44 and 46 laterally arrayed on the base 22 proximate the distal end 48 and 50 of the base member 22. Again, a pair of ribs 52 and 54 extend substantially perpendicularly from the base member 22 which may be used for guiding and supporting the female closure element 20 as it runs through a conventional bag making machine 204 (FIG. 5) and, for cushioning when engaging with fastener assembly 12. By this it is meant that prior to interlocking barb 18 with track 24, closure element 12 may be supported on ribs 36 and 38 at their respective tips 56 and 58, in those systems where male closure element 12 and female closure element 20 are fed separately into the bag making machine 204. Guide tracks 200 and 202 (FIG. 6) may be provided for supporting the ribs without touching the barb 18 or base 14, or track 24 or base 22. As a result, friction between the fasteners 10 and the tracks 200 and 202 is significantly reduced, thereby making it easier to guide the fasteners 10 through a bag making machine 204, and also allowing the machine 204 to run faster. This reduction in friction is enhanced by having tips 56 and 58 rounded to reduce the surface area in touch with the guide tracks 200 and 204. Similarly, ribs 52 and 54 are rounded at their tips 60 and 62 respectively.

Figure 5:
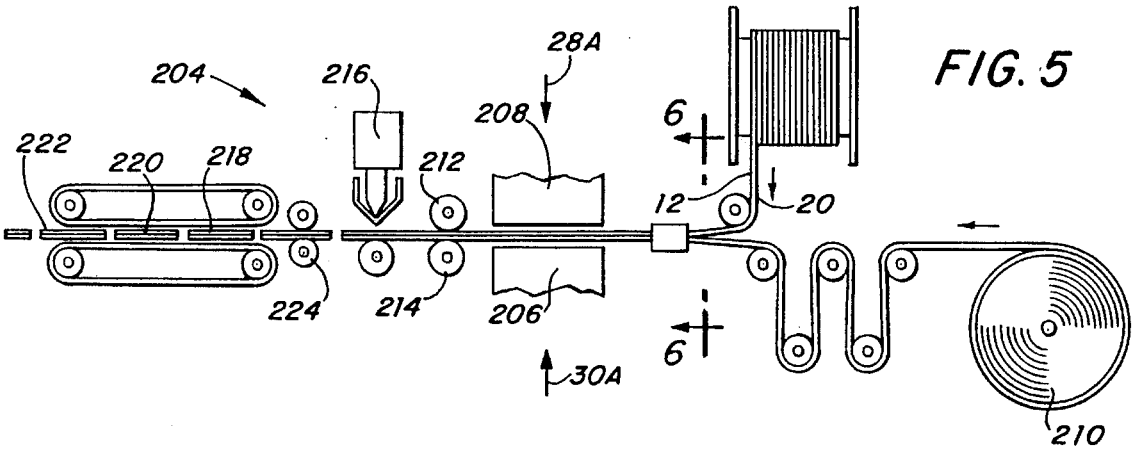
FIG. 5 of the drawings is a schematic showing guide tracks for supporting the fastener assemblies of the present invention and section line 6—6.

As is shown in FIG. 3, the stem 16 and barb 18 are of sufficient length to extend perpendicularly slightly beyond the ribs 36 and 38 of the male fastener 12 into the C-shaped track 24, and hold the closure elements 12 and 20 together during sealing of the fastener assemblies 12 and 20 to walls 112 and 114. This is accomplished by inserting the interlocked closure elements 12 and 20 in a continuous strand between a folded U-shaped web of film 210 such as polyethylene as shown in FIG. 5. However, unlike prior art fasteners, stem 16 of the present invention has ribs 36 and 38 which abut against and are cushioned against ribs 52 and 54 when barb 18 is interlocked with track 24. As a result, when pressure is applied for sealing the closure elements 12 and 20 to bag 110, the ribs 52 and 54 cushion ribs 36 and 38, so base members 14 and 22 can flatten against bag walls 112 and 114 for better sealing. In addition, cushioning of ribs 36 and 38 against ribs 52 and 54 prevents closure element 12 from resting on and being supported by barb 18 and stem 16 after interlocking of barb 18 with curved track 24.

As shown in FIG. 3 in a preferred embodiment, ribs 52 and 54 on female closure elements 20 are angled inwardly, in this case being at approximately 70°. The centerlines 64 and 66 respectively of ribs 52 and 54 are set inwardly from the edges 68 and 70 respectively, approximately 0.02". Ribs 36 and 38, however, are substantially perpendicular from base 14. As a result, when closure elements 12 and 20 are interlocked, rib 36 is cushioned against rib 52 at inside surface 72. Similarly, rib 38 is cushioned against rib 54 at inside surface 74. If sealing pressure 28A and 30A is applied to fastener 12 and 20 at other than 90°, ribs 36, 38, 52 and 54 straighten the fasteners out. Similarly, when excess pressure is applied for sealing fasteners 12 and 20 to the inside walls 112 and 114 of bag 110, ribs 36, 38, 52 and 54 act as shock absorbers to support the closure elements 12 and 20 against each other and prevent barb 18 from being crushed or deformed within curved track 24.

As seen in FIG. 4, in an alternate environment, ribs 36 and 38 are substantially perpendicular from base 14. However, the inside surfaces 72 and 74 are angled outwardly more than the embodiment shown in FIG. 3. Specifically, the inside surface 72 of rib 36 is angled downwardly at an angle of approximately 60° from the base 14 in the embodiment shown in FIG. 4. In the embodiment in FIG. 3, the inside surface 72 of rib 36 is angled downwardly at approximately 5° from base 14. Similarly, inside surface 74 of rib 38 is angled downwardly at an angle of approximately 60° whereas in FIG. 3, rib 38 is angled downwardly at an angle of approximately 5°. Accordingly, in the embodiment shown in FIG. 3, ribs 36 and 38 do not cushion against ribs 52 and 54, until barb 18 is close to the bottom 104 of curved track 24. Obviously, the degree of penetration of barb 18 and stem 16 into curved track 24 may be controlled by controlling the length and angles of the ribs 36, 38, 52, and 54. It is important to note, however, that in all of the embodiments of the present invention, the ribs 52 and 54 are separated significantly less than the ribs 36 and 38 on male closure assembly 12. As a result, the male fastener assembly 12 will deform more than the female fastener assembly 20. This results in the legs 26 of curve track 24 gripping barb 18 more tightly as sealing pressure is applied inwardly on force vectors 28*a* and 30*a*.

An additional feature of the invention is the construction of closure elements 12 and 20 so that when bag 110 is opened along its top surface 118, the amount of force required to separate closure elements 12 and 20 is less than the amount of force required for product within bag 110 pressing against interlocked closure elements 12 and 20 to separate. This is commonly known in the industry as a differential opening force. In the present invention, this is provided by three mechanisms. As shown in FIG. 3, barb 18 has two extending prongs 76 and 78 which extend substantially laterally from stem 16. In the embodiment shown, prong 78 is longer than prong 76. As a result, when opening force from within the bag 110 presses against the distal ends 40 and 48 of closure elements 12 and 20, it forces ribs 36 and 52 more closely together while at the same time prong 78 engages more tightly against surface 80 on leg 26 of curved track 24. This braces prong 78 against surface 80 thereby inhibiting opening of the bag 110. The force required to open the bag 110 from within may be adjusted by choosing the angles of the prongs 76 and 78, the curvature of the corner surfaces 82 and 84, the length of tips 86 and 88 of legs 26, and the respective size of legs 26 on the left and right sides of curved track 24. In addition, in the embodiment shown, a channel 90 is formed between prong 78 and stem 16. When opening force is applied from within the bag 110, prong 78 tends to be bent downwardly, thereby opening channel 90 so that tip 88 is more firmly inserted therein. An additional means of providing a differential opening force is by increasing the angle or thickness of rib 36 so as to provide increased resistance to opening.

In a preferred embodiment, closure elements 12 and 20 have a width of approximately 0.130 inches ±0.005. Male closure element 12 has a height from the outside surface 32 of base 14 to the tip 92 of barb 18 of approximately 0.050" to 0.060"±0.010". Similarly, female closure element 20 has a height from base 22 to the tip 94 of leg 26 of approximately 0.060"±0.010" inches. The bases 14 and 22 of closure elements 12 and 20 have a thickness of approximately 0.020"±0.005". Ribs 36, 30, and 38 have a thickness of approximately 0.010±0.005 inches. Ribs 52 and 54 have a thickness of approximately 0.020"±0.005". In the embodiment shown in FIG. 4, an additional bump 96 may be provided to engage inside surface 72 and further resist opening of fastener closure elements 12 and 20 from product within bag 110.

In a preferred embodiment, fastener assemblies 12 and 20 are constructed of Petrothene NA 420-127 low density polyethylene resin. NA 420-127 has medium slip and medium anti-block properties incorporated therein. The physical properties of Petrothene NA 427 may be seen in the attached advertising literature which is incorporated herein by reference.

Returning to FIG. 4, when base members 14 and 22 are compressed by sealing pressure 20*a* and 30*a*, during the sealing operation to inside bag walls 112 and 114, the curved base members 14 and 22 flatten and correct any misalignment of the base members relative to the film; in other words, the base member is both compressible and curved so as to act as a cushion and improve sealing.

As further seen in FIGS. 3 and 4, on the distal ends 48 and 50 of base 22 are a pair of bumpers 96 and 98 which are curved. Bumpers 96 and 98 serve two purposes. During sealing of closure elements 12 and 20 to bag 110, when the closure elements 12 and 20 are compressed by sealing forces 20*a* and 30*a*, bumpers 96 and 98 act as stops for preventing the tips 56 and 58 of ribs 36 and 38 respectively from passing below curves 100 and 102. As a result, barb 18 does not press strongly against the bottom 104 of curved track 24. This prevents deformation of barb 18 and stem 16 so that the closure elements 12 and 20 operate properly in interlocking and disengaging. In addition, when product within bag 110 presses against ribs 36 and 52, bumper 96 again acts as a stop to prevent tip 56 from sliding downwardly, thereby opening bag 110. This function can be increased or decreased as desired by increasing the size of bumper 96. As a result, a new and improved fastener assembly is provided.

As shown in FIG. 5 of the drawings, bag making machine 204 includes sealing jaws 206 and 208. U folded web 210 is dispensed into bag making machine 204 with interlocked closure elements 12 and 20 being disposed on the inside surface of the web 210. Jaws 206 and 208 press downwardly on web 210 along force vectors 20*a* and 30*a* to connect the web 210 and closure elements 12 and 20. Pressure of 90 psi is applied and jaws 206 and 208 heated to 330° F. to 390° F. As a result closure elements 12 and 20 are sealed on their bases 14 and 22, (FIG. 3), preferably in the center thereof and with a sealing width of 0.50±0.010 inches. Heated rollers 212 and 214 then effect longitudinal seals of web 210. Hot knife 216 then cuts off web 210 into individual bags 218, 220 and 222, etc. These bags are carried away by conveyor 224.

Figure 6:
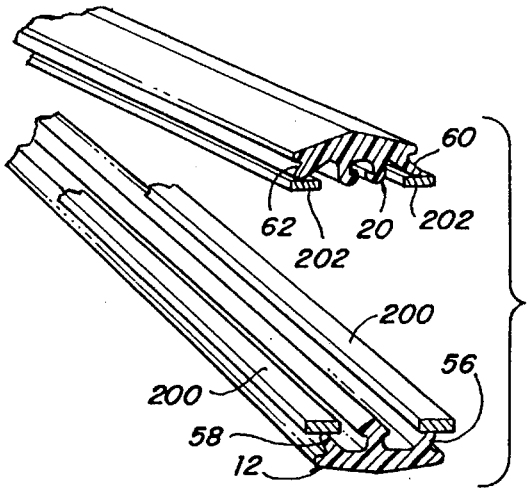
FIG. 6 of the drawings is a cross section along section line 6—6 in FIG. 5 and shows a detail of guide tracks and interaction with the fastener assemblies.

FIG. 6 shows a cross section along line 6—6 of FIG. 5 of guide tracks 200 and 202. Fastener assemblies 12 and 20 are shown being guided into web 210. Fastener assemblies 12 and 20 can be seen resting on the tips 56, 58, 60 and 62 of their respective supporting ribs.

I claim:

1. A fastener assembly for a reclosable, plastic container, said assembly comprising:

a male closure element having a male base member and a stem and a barb element externally substantially perpendicularly therefrom, said male base member being elastically deformable and resilient and having at least two male base member engaging portions thereof; and a female closure element comprising a female base member and a substantially C-shaped track disposed thereon, said C shaped track having a pair of curved legs extending from said female base member, said female closure element being formed such that said male closure element and said female closure element are selectively engaged in an interlocking relationship or disengaged, said female base member further being elastically deformable and resilient and having at least two female base member portions thereof projecting angularly inward, in which said elastically deformable male base member engaging portions inwardly deform said female base member portions thereby facilitating sealing of said fastener assembly upon engagement thereof and assembly of said fastener assembly to said reclosable plastic container.

2. The fastener assembly of claim 1 wherein said male base member has a curved exterior portion which deforms when sealing pressure is applied, thereby facilitating sealing of said fastener assembly to said container.

3. The fastener assembly of claim 1 wherein said female base member has a curved exterior portion which deforms when sealing pressure is applied, thereby facilitating sealing of said fastener assembly to said container.

4. The fastener assembly of claim 1 wherein said male base member engaging portion further comprises a pair of laterally arrayed flanges having a rib proximate each of the distal ends thereof, said ribs facilitating guiding and support of said fastener assembly.

5. The fastener assembly of claim 4 wherein said barb and said stem extend a sufficient distance perpendicularly beyond said ribs so that said ribs act as shock absorbers between said male and female closure assemblies during interlocking of said male and female closure assembly, whereby the life expectancy of said barb element and said C-shaped track is extended.

6. The fastener assembly of claim 1 wherein said female base member portion further comprises a pair of laterally arrayed flanges having a rib proximate each of the distal ends of said base member, said ribs facilitating guiding and support of said fastener assembly.

7. The fastener assembly of claim 6 wherein each of said ribs have a narrowed tip, said flanges and said tips being constructed and arranged for slidably supporting said fastener assembly.

8. The fastener assembly of claim 6 wherein each of said ribs comprises a curved bumper element proximate thereto, said curved bumper elements on said female closure element being constructed and arranged for cushioned impact against the inside surface of said ribs on said male closure elements so as to align said male and female closure elements during sealing, and absorb pressure applied against said male and female closure elements during sealing.

9. The fastener assembly of claim 6 wherein each of said ribs have a rounded tip, said flanges and said tips being constructed and arranged for cushioning said fastener assembly.

10. The fastener assembly of claim 1 wherein said male base member engaging portion and female base member portion comprise a pair of laterally arranged flanges having a rib proximate each of the distal ends of said base member, said ribs facilitating guiding and support of said fastener assemblies.

11. The fastener assembly of claim 10 wherein at least one of said base members comprise a pair of curved bumper elements proximate the lateral ends of said base member, said curved bumper elements being constructed and arranged to impact against an opposing rib member, thereby cushioning said fastener elements during sealing to said reclosable plastic container.

12. The fastener assembly of claim 1 wherein said male and female engaging portions further comprise ribs, and said ribs on said female base member portion project angularly inward at an angle <90, said ribs being effective to cushion impact between said male closure element and said female element, thereby facilitating sealing of said closure elements to said reclosable flexible container.

13. The fastener assembly of claim 12 wherein said barb member includes a channel proximate the base thereof and said C-shaped track includes a flange extending from one of said curved legs proximate to the distal end thereof, said flange being constructed positioned and arranged so as when said male and female closure elements are engaged in an interlocking relationship, said flanges retard disengagement of said closure elements on the product side of said closure elements.

14. The fastener assembly of claim 1 wherein said male closure element and said female closure element are constructed and arranged so as to provide a differential opening force between the product side and the consumer side of said reclosable plastic container, whereby inadvertent opening of said reclosable plastic container is inhibited.

15. A fastener assembly for a reclosable plastic container, said assembly comprising:

a sliderless closure element having a base member and means for interlocking with an opposed closure element, said base member being elastically deformable, resilient, and of a size and shape to increase the holding power of said closure element when said closure element is engaged with said opposed closure element while providing for relatively effortless engagement of said closure element with said opposed closure element so as to facilitate sealing of said base member to said reclosable plastic container and of said base member to a second base member having said opposed closure element.

16. The fastener assembly of claim 15, wherein said base member has a thickness of 0.20±0.005; and a modulus of elasticity of 22,000 psi±4,000 psi with ASTU D 882.

17. The fastener assembly of claim 15 wherein elasticity of said base member is effective to cause plastic deformation of said base member against said reclosable plastic container when said base member is compressed against said reclosable plastic container, so that non parallel alignment of said base member and said reclosable plastic container is corrected to substantially parallel alignment, thereby facilitating sealing of said base member to said reclosable plastic container.

18. The fastener assembly of claim 15 wherein said base member has a curved exterior portion which deforms when sealing pressure is applied, thereby facilitating sealing of said fastener assembly to said container.

19. The fastener assembly of claim 15 wherein said base member comprises a pair of laterally arrayed flanges having a rib proximate each of the distal ends thereof, said flanges facilitating guiding and support of said fastener assembly.

20. The fastener assembly of claim 19 wherein each of said ribs have a narrowed tip, said flanges and said tips being constructed and arranged for slidably supporting said fastener assembly.

21. The fastener assembly of claim 15 wherein said closure element and said opposed closure element each have a product side and a consumer side, said closure element and said opposed closure element being constructed and arranged for disengaging more easily on said consumer side than said product side, so as to selectively retain product in said reclosable plastic container.

22. A sliderless fastener assembly for a reclosable plastic container, said assembly comprising:

a male closure element having an elastically deformable male base member, a substantially perpendicular stem and a barb element;

a female closure element comprising a female base member and a substantially C-shaped track disposed thereon, said C-shaped track having a pair of legs extending from said female base member, said female closure element being formed such that said male closure element and said female closure element are selectively engaged in an interlocking relationship or disengaged, said female base member further being elastically deformable and resilient, said elastically deformable male and female base members being effective to facilitate sealing of said fastener assemblies to said reclosable plastic container; said male fastener assembly and said opposed female fastener assembly each have a product side and a consumer side, said fastener assemblies being constructed and arranged for disengaging more easily on said consumer side than said product side, so as to selectively retain product in said reclosable plastic container; and, means for increasing the holding power of said female closure element upon engagement of said female closure element with said male closure element.

23. A fastener assembly for a reclosable, plastic container, said assembly comprising:

a male closure element having a male base member and a stem and a barb element externally substantially perpendicularly therefrom; and a female closure element comprising a female base member and a substantially C-shaped track disposed thereon, said C shaped track having a pair of curved legs extending from said female base member, said female closure element being formed such that said male closure element and said female closure element are selectively engaged in an interlocking relationship or disengaged, wherein each of said ribs comprises a curved bumper element proximate thereto, said curved bumper elements on said female closure element being constructed and arranged for cushioned impact against the inside surface of said ribs on said male closure elements so as to align said male and female closure elements during sealing, and absorb pressure applied against said male and female closure elements during sealing.

24. A fastener assembly for a reclosable, plastic container, said assembly comprising:

a male closure element having a male base member and a stem and a barb element externally substantially perpendicularly therefrom; and a female closure element comprising a female base member and a substantially C-shaped track disposed thereon, said C shaped track having a pair of curved legs extending from said female base member, said female closure element being formed such that said male closure element and said female closure element are selectively engaged in an interlocking relationship or disengaged:

said barb member further including a channel proximate the base thereof and said C-shaped track including a pair of flange extending inwardly therefrom proximate the distal end thereof, said stem being constructed positioned and arranged so that when said male and female closure elements are engaged in an interlocking relationship, said stem engages said channel and retards disengagement of said closure elements on the product side of said closure elements.

* * * * *

UNITED STATES PATENT AND TRADEMARK OFFICE

CERTIFICATE OF CORRECTION

PATENT NO. : 5,577,305
DATED : Nov. 26, 1996
INVENTOR(S) : James R. Johnson

It is certified that error appears in the above-indentified patent and that said Letters Patent is hereby corrected as shown below:

Column 1, Line 25, delete first occurrence of "with profiles".

Signed and Sealed this

Twenty-sixth Day of August, 1997

*Attest:*

Bruce Lehman

BRUCE LEHMAN

*Attesting Officer*

*Commissioner of Patents and Trademarks*